United States Patent [19]

Sakai et al.

[11] 4,218,850

[45] Aug. 26, 1980

[54] CAMBERING DEVICES OF ROLL GRINDING LATHES

[75] Inventors: Yasuo Sakai; Kazuo Nagashima; Harukatsu Goto, all of Numazu, Japan

[73] Assignee: Toshiba Kikai Kabushiki Kaisha, Tokyo, Japan

[21] Appl. No.: 944,294

[22] Filed: Sep. 21, 1978

[30] Foreign Application Priority Data

Sep. 26, 1977 [JP] Japan ..... 52-115401

[51] Int. Cl.[3] ..... B24B 17/02

[52] U.S. Cl. ..... 51/49; 51/50 PC; 51/165.71; 51/165.89

[58] Field of Search ..... 51/49, 50 PC, 165.71, 51/165.89; 409/92, 107, 121; 82/2 B

[56] References Cited

U.S. PATENT DOCUMENTS

| | | | |
|---|---|---|---|
| 3,280,512 | 10/1966 | Seidel | 51/165.89 |
| 3,398,489 | 8/1968 | Rohrer | 51/49 X |
| 3,456,394 | 7/1969 | Welsh | 51/49 X |
| 3,461,612 | 8/1969 | Parrela | 51/49 |
| 3,616,578 | 11/1971 | Clark | 51/49 X |
| 3,685,375 | 8/1972 | Hill | 51/49 X |
| 3,889,424 | 6/1975 | Buhayar | 51/49 |

*Primary Examiner*—Gary L. Smith

*Attorney, Agent, or Firm*—Koda and Androlia

[57] ABSTRACT

In a cambering device of a roll grinding lathe of the type wherein a grinding wheel is moved toward and away from the center of a roll by means of a cambering cam while the grinding wheel is moved in the longitudinal direction of the roll, there are provided electrical or mechanical means to detect the longitudinal position of the grinding wheel and electrical or mechanical means controlled by the position detecting means for varying the rotational speed or the cambering cam so as to vary the cambering profile.

6 Claims, 21 Drawing Figures

FIG. 7
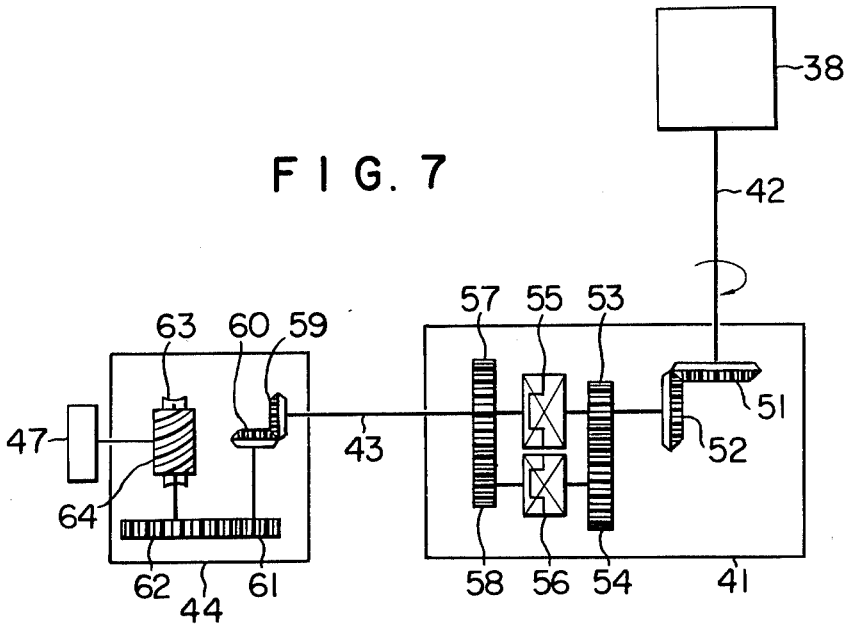
FIG. 8A
FIG. 8B
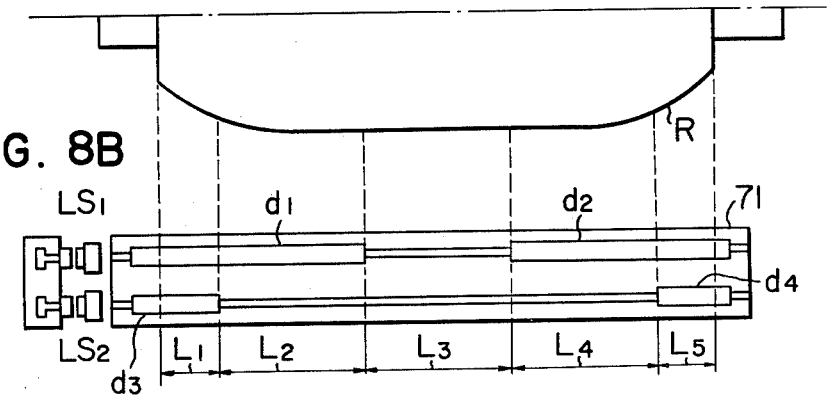
FIG. 8C
| | $L_1$ | $L_2$ | $L_3$ | $L_4$ | $L_5$ |
|---|---|---|---|---|---|
| $LS_1$ | ON | ON | OFF | ON | ON |
| $LS_2$ | ON | OFF | OFF | OFF | ON |

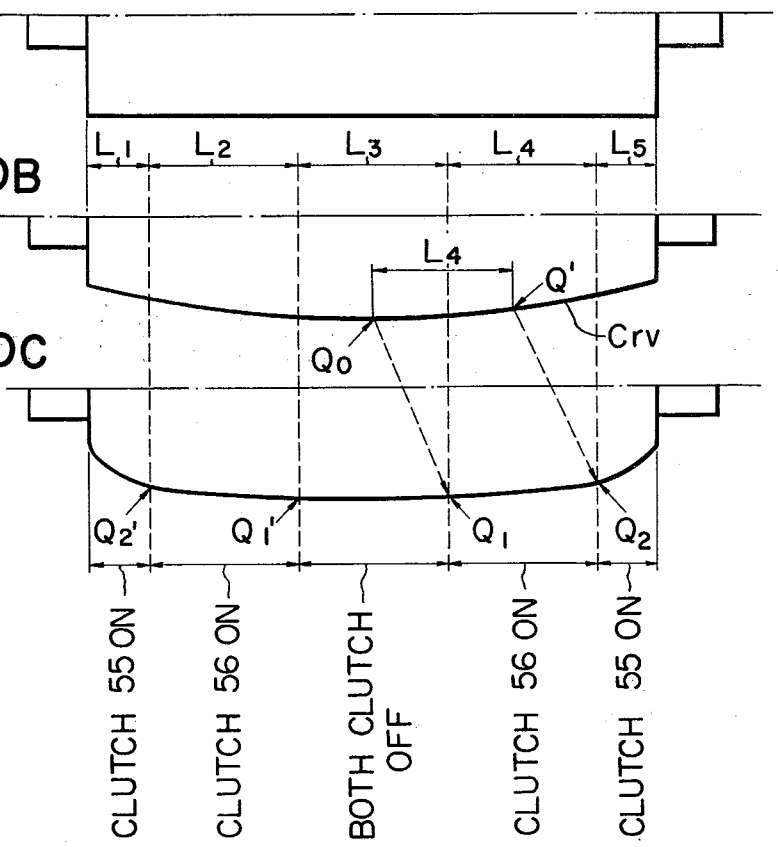
FIG. 10A
FIG. 10B
FIG. 10C
FIG. 9
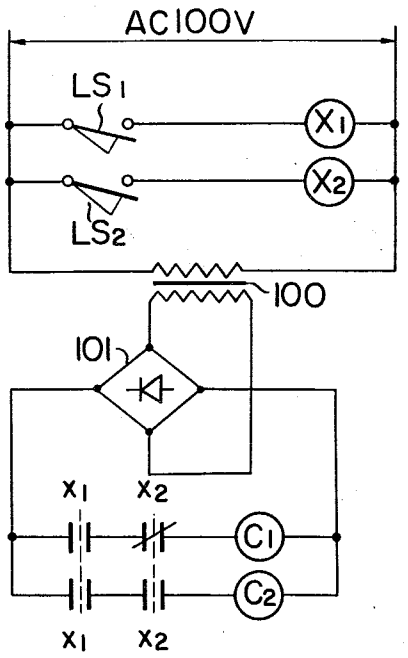

CAMBERING DEVICES OF ROLL GRINDING LATHES

BACKGROUND OF THE INVENTION

This invention relates to a roll grinding lathe provided with a cambering device.

As is well known in the art, rolls of a rolling mill for manufacturing metal sheets or strips are crowned or cambered for the purpose of producing strips or sheets having a uniform thickness in the transverse direction. For this reason, the roll grinding lathe designed for manufacturing such cambered roll is equipped with a cambering device which controls the position of a grinding wheel so as to finish a roll having a desired cambering profile.

According to a prior art roll grinding lathe of the type referred to above, a cam having a profile corresponding to a desired cambering profile or curve is provided and while a grinding wheel mounted on a grinding wheel head is moved in the longitudinal direction along the barrel surface of a roll to be ground, the cam is rotated in synchronism with the longitudinal movement of the grinding wheel by mechanical means so as to swing the grinding wheel head about a pivot in accordance with the lift of the cam. In other words, the grinding wheel is moved toward and away from the center of the roll to form a desired cambering profile.

One example of the prior art cambering device is shown in FIG. 1. As shown, a horizontal pivot shaft 12 is provided for the lefthand side of a reciprocating carriage 11, and an sub-base 13 is tiltably mounted on pivot 12. One end of a cambering lever 14 is pivotally connected to the upper surface of the reciprocating carriage 11 and a follower roller 15 engaging a cambering cam 16 is mounted on the righthand end of the cambering lever 14.

Although not shown in the drawing, the shaft 17 of cam 16 is connected with a shaft branched from a driving mechanism that moves the reciprocating carriage 11 in the longitudinal direction of pivot shaft 12 so that the shaft 17 is rotated synchronously with the longitudinal movement of the reciprocating carriage by mechanical synchronizing means. The upper surface of lever 14 is urged against a follower roller 18 mounted on the lower end of a bracket 18 secured to the lower surface of the sub-base 13.

A grinding wheel head 19 supporting a grinding wheel 20 and a driving motor thereof, not shown, is slidably mounted on the sub-base 13 so as to be movable in the direction of arrow A, or to be fed toward a roll R to be ground independently of the operation of the cambering cam 16. By adjusting the position of the follower roller 18 with respect to the lever 14, as shown by arrow B, the amount of swinging of the grinding wheel head 19, and hence the angle of rotation of the grinding wheel 20 about pivot shaft 12 which is caused by the rotation of cam 16 can be varied. As shown in FIG. 2, by varying the "lever ratio" as above described various camber profiles $l_0$, $l_1$, $l_2$ and $l_3$ can be obtained having different amount of cambering. Thus according to the prior art cambering device, the type of the resulting cambering profiles is limited to a group of curves in which the amount of cambering varies at a constant rate as the grinding wheel is moved longitudinally.

SUMMARY OF THE INVENTION

It is an object of this invention to provide a roll grinding lathe provided with an improved roll cambering device capable of forming many types of cambering profiles by using a single cam.

Another object of this invention is to provide an improved roll grinding lathe capable of forming many types of cambering profiles by using a relatively simple mechanical or electrical control device for the cambering cam.

According to this invention, these and other objects can be accomplished by providing a cambering device of a roll grinding lathe of the type comprising means for driving a grinding wheel in the longitudinal direction of the roll, a cambering cam for swinging the grinding wheel toward and away from the center of the roll, and means for rotating the cam in accordance with a position of the grinding wheel in the longitudinal direction thereby forming a cambered profile on the surface of the roll, characterized in that there are provided means to detect a predetermined position along the longitudinal axis of the roll to which the grinding wheel has been moved during longitudinal movement, and means responsive to the output of the position detecting means for varying the rotational speed of the cam.

BRIEF DESCRIPTION OF THE DRAWINGS

In the accompanying drawings:

FIG. 7 is a diagrammatic representation of a driving system which transmits the rotation derived out from the longitudinally driving mechanism to the cambering cam;

FIGS. 8A–8C are plan views showing a cambered roll and the arrangement of dogs and limit switches which set the longitudinal position for ON-OFF control the clutch shown in FIG. 7;

FIG. 9 shows an electric circuit for energizing the clutch shown in FIG. 8;

FIGS. 10A, 10B and 10C show cambering curves obtained by the prior art cambering device and by the cambering device of this invention;

DESCRIPTION OF THE PREFERRED EMBODIMENT

Figure 1:
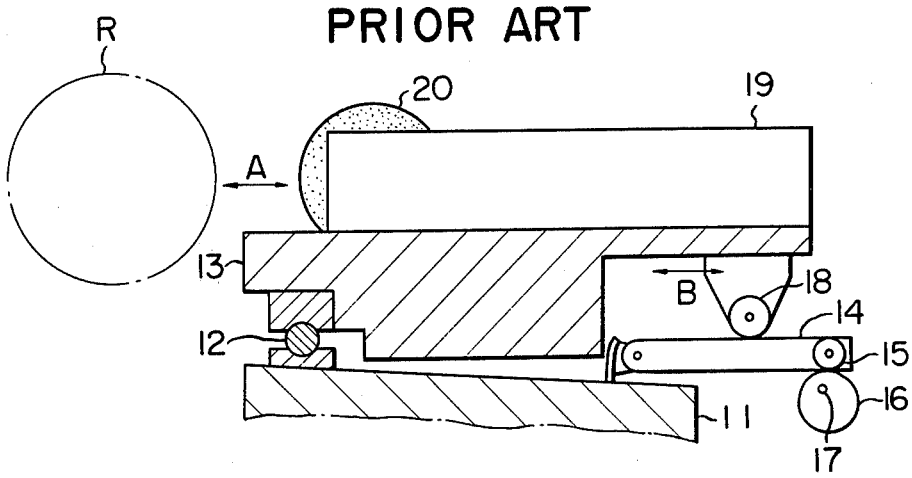
FIG. 1 PRIOR ART
FIG. 1 is a side view showing a prior art cambering device.
Figure 2:
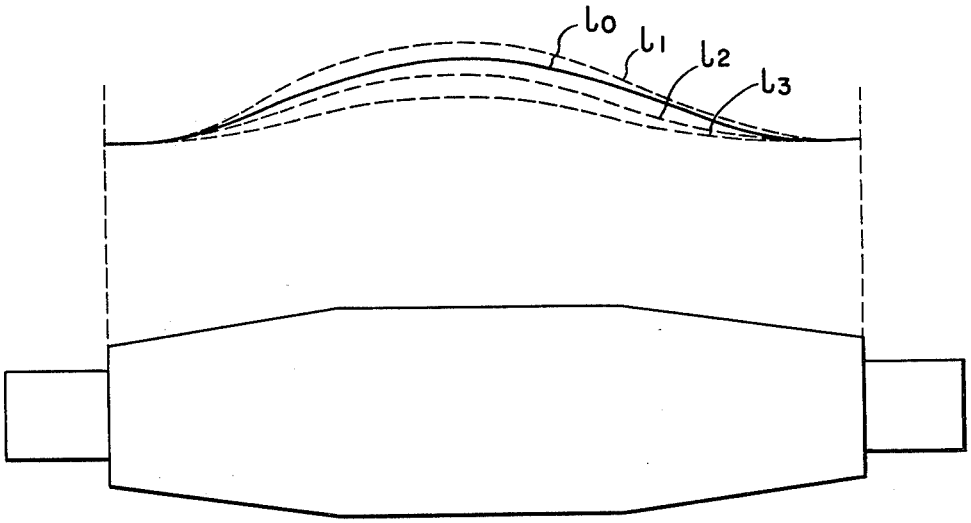
FIG. 2 PRIOR ART
FIG. 2 is a graph showing a group of cambering curves obtained by a prior art cambering device utilizing a cam shown in FIG. 1.
Figure 3:
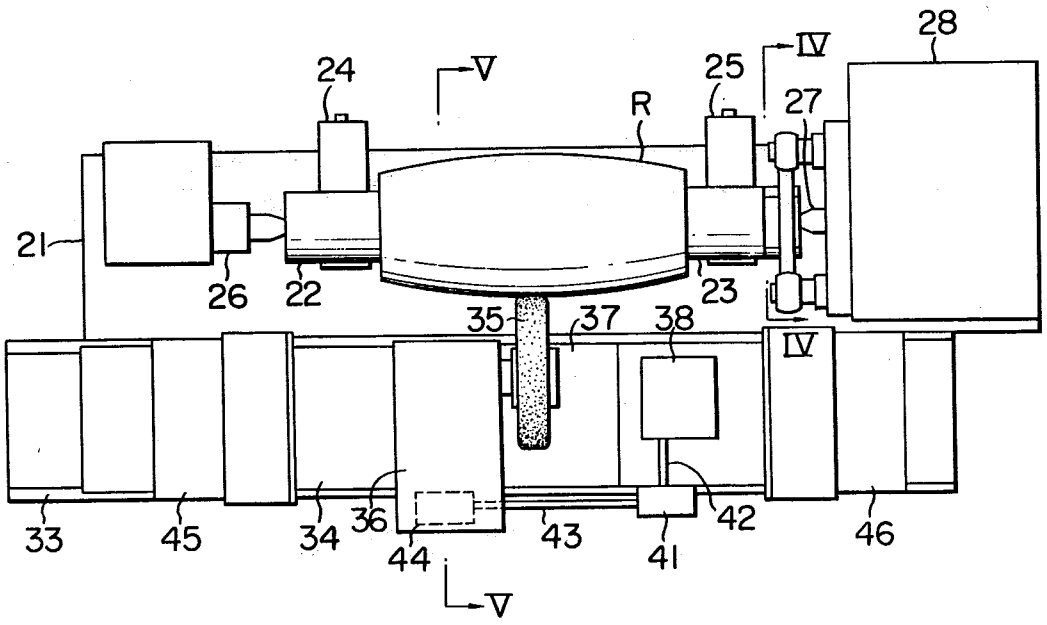
FIG. 3 is a plan view showing one embodiment of the roll grinding lathe according to this invention.

Referring now to FIG. 3 which shows a preferred embodiment of this invention, on a front bed 21 are mounted pedestals 24 and 25 adapted to support opposite roll necks 22 and 23 of a roll R to be ground, a tailstock 26 center adapted to engage a tapered opening at the end of the lefthand roll neck 23 and a headstock 28 having a center 27 adapted to engage a tapered opening at the end of the righthand roll neck 23.

Figure 4:
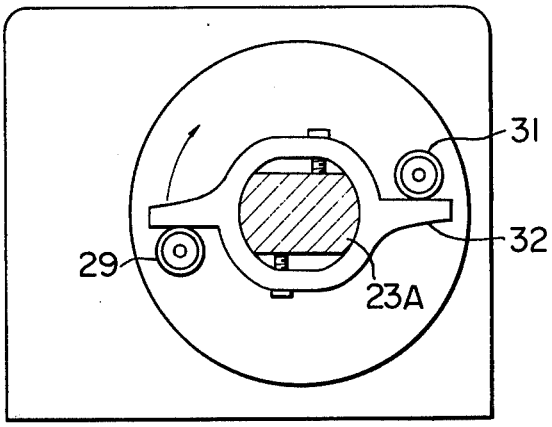
FIG. 4 is a cross-sectional view taken along a line IV—IV shown in FIG. 3.

As shown in FIG. 4, rollers 29 and 31 are mounted on the headstock 28 to be revolvable in the clockwise direction. A driving member 23A is bolted to the end portion 23A of the shaft 23 so that when the rollers 29 and 31 are revolved the roll R is rotated on the pedestals 24 and 25. A rear bed 33 is secured on the front side of the front bed 21 for slidably supporting a reciprocating carriage 34. The reciprocating carriage 34 carries a sub-base 37 (FIG. 5) supporting a grinding wheel head 36 provided with a grinding wheel 35, and a longitudinally driving mechanism 38 of the reciprocating carriage 34. The longitudinally driving mechanism 38 is provided with a helical gear shaft which projects obliquely and downwardly to engage a longitudinal rock 39 (see FIG. 6).

A gear box 41 containing a variable ratio gear train is driven by a shaft 42 rotated synchronously with the helical gear shaft 40 for transmitting the rotation through an intermediate shaft 43 to a cambering cam driving member 44 mounted on the lower side of the grinding wheel head 36. Telescopic covers 45 and 45 are mounted on the opposite sides of the reciprocating carriage 34 for protecting the sliding surface of the rear bed 33.

Figure 5:
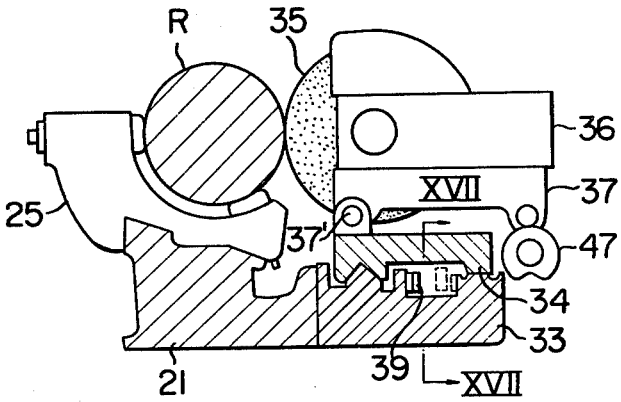
FIG. 5 is a cross-sectional view taken along a line V—V shown in FIG. 3.
Figure 6:
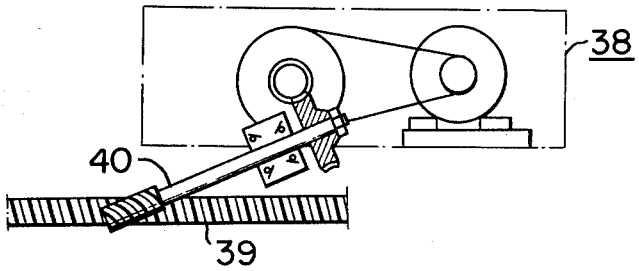
FIG. 6 is a plan view showing a longitudinally drive mechanism for a reciprocating carriage.

As shown in FIG. 5, when a cambering cam 47 is rotated, the sub-base 37 is tilted about a pivot pin 37' to advance the grinding wheel 35 toward the roll R thus forming a camber.

FIG. 7 shows one example of the driving mechanism for the cambering cam 47. As shown, a shaft 42 driven by the longitudinally driving mechanism drives gears 53 and 54 through a pair of bevel gears 51 and 52. Gears 57 and 58 are coupled to gears 53 and 54 through electromagnetic clutches 55 and 56, respectively. The rotation of the intermediate shaft 43 integral with gear 57 is transmitted to gears 61 and 62 via bevel gears 59 and 60. The speed of gear 62 is reduced by a worm 63 and a worm wheel 64 which carries the cambering cam 47. Accordingly, with the reduction gear box 41, it is possible to obtain two speeds, one through bevel gear 52, gears 53, clutch 55 and gear 57, the other through gears 53, 54, clutch 56 and gears 58 and 57. In the latter case the clutch 55 is disengaged.

FIG. 8A shows one half of the roll R and FIG. 8B an arrnagement of dogs $d_1$ through $d_4$ which are arranged in two rows in the longitudinal direction of the roll. Grooves are formed on the upper surface of a base plate 71 for slidably positioning the dogs. The base plate 71 is mounted on the rear bed 33 which is shown in FIG. 3. Limit switches $LS_1$ and $LS_2$ are mounted on the reciprocating carriage 34 to correspond to the position of the grinding wheel. The limit switches $LS_1$ and $LS_2$ are closed (ON) when their lower surfaces engage the dogs, whereas opened (OFF) when disengage the dogs. FIG. 8C is a table showing the ON and OFF states of the limit switches $LS_1$ and $LS_2$ at various positions of the grinding wheel along sections $L_1$–$L_5$ of the roll.

FIG. 9 shows a control circuit of the electromagnetic clutches 55 and 56 shown in FIG, 7. Auxiliary relays $X_1$ and $X_2$ are connected to be energized by limit switches $LS_1$ and $LS_2$ respectively. A rectifier 101 is energized by a transformer 100 to energize coils $C_1$ and $C_2$ of the clutches 56 and 55 through contacts $x_1$ and $x_2$ of relays $X_1$ and $X_2$ respectively. In section $L_3$ shown in FIGS. 8B and 8C, since both limit switches $L_1$ and $L_2$ are OFF, coils $C_1$ and $C_2$ are not energized so that the rotation of shaft 42 (FIG. 7) is not transmitted to the intermediate shaft 43 and cam 47. In section $L_1$, however, since both limit switch $LS_1$ and $LS_2$ are ON, coil $C_1$ of clutch 56 is deenergized, whereas coil $C_2$ of clutch 55 is energized. In this case, the rotation of shaft 42 is transmitted directly to intermediate shaft 43 from bevel gear 52. In the same manner, in section $L_2$, coil $C_1$ (clutch 56) is energized, whereas coil $C_2$ (clutch 55) is deenergized so that the rotation of the bevel gear 52 is transmitted to the intermediate shaft 43 and the cam 47 after being reduced by gears 53, 54, clutch 56 and gears 58, 57. Since the surface of the roll R is generally ground symmetrically with respect to the center, in sections $L_4$ and $L_5$, the electromagnetic clutches 55 and 56 are operated in the same manner as above described.

FIG. 10A shows the profile of the roll before grinding and FIG. 10B shows the cambering curve $C_{rv}$ obtained by grinding the roll with only the clutch 56 engaged so as to transmit the rotation of shaft through bevel gears 51, 52, gears 53, 54, clutch 56, gears 58, 57, shaft 43 to cam 47. The curve $C_{rv}$ thus obtained is the same as that obtained by the conventional cambering device and the profile of the curve $C_{rv}$ is determined solely by the cam 47.

FIG. 10C shows the same cambering curve as that shown in FIG. 8A wherein in section $L_3$ both electromagnetic clutches 55 and 56 are disengaged so that cam 47 is not rotated. In section $L_4$, only clutch 55 is engaged so that the displacement of the curve between points $Q_1$ and $Q_2$ is the same as that between the central point $Q_0$ and point Q' spaced therefrom by $L_4$. In section $L_5$, only clutch 55 is engaged so that between point $Q_2$ and the righthand end of the roll, the cam 47 is rotated at a speed higher than that between points $Q_1$ and $Q_2$. Accordingly, the inclination of the curve is larger than that of the corresponding portion shown in FIG. 10B. Points $Q_1'$ and $Q_2'$ correspond to points $Q_1$ and $Q_2$ respectively. By comparing FIG. 10B with FIG. 10C it will be noted that the shapes of the curves at the central section $L_3$ and the end section $L_5$ are quite different which is caused by the fact that the speed of the cam 47 is varied during the longitudinal movement of the carriage.

Figure 11:
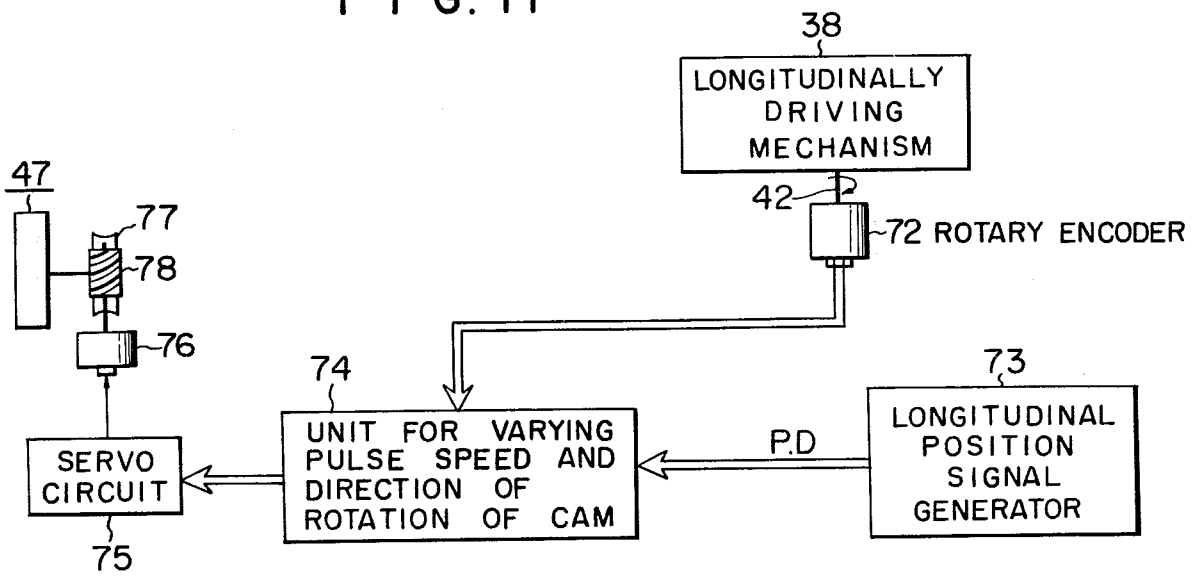
FIG. 11 shows a system for electrically synchronizing the cambering device with the longitudinal movement.

FIG. 11 illustrates another embodiment of this invention. In the arrangement shown in FIG. 7, the rotation of shaft 42 extending from the longitudinally driving mechanism 38 is transmitted to cam 47 through gear box 41 of a variable gear ratio. Accordingly, where it is desired to set a plurality of longitudinal positions at which the speed of the cam is to be varied the construction of the gear box becomes complicated. In the modification shown in FIG. 11, such speed change is accomplished by electrical means. More particularly a rotary encoder 42 is mounted on shaft 42 extending from the longitudinally driving mechanism 38, and two phase pulse trains AP and BP (see FIG. 12) generated by the encoder are applied to a unit 74 for varying the speed and the direction of rotation of the cam. A longitudinal position signal generator 73 is provided to produce signals at a plurality of longitudinally spaced apart positions and to apply the position signals to unit 74. The number of generated signals can be increased by arranging the dogs shown in FIG. 8B in three or more rows. A servo circuit 75 including a digital analogue (D/A) converter, not shown, is connected to the output of unit 74 to operate a servomotor 76 which drives the cambering cam 47 through worm 78 and worm wheel 77. A pulse motor drive circuit and a pulse motor may be substituted for the serve circuit 75 and servomotor 76 respectively.

With this modification, it is possible to consaruct the entire system with a digital system. Furthermore, the rotary encoder may be substituted by a linear movement detector, such as a magnetic scale (see FIG. 17). In this case, the longitudinally driving mechanism may be different from those shown in FIGS. 3 and 6 which utilize a rack, and may be any other system that produces a pulse train corresponding to the longitudinal position of the reciprocating carriage.

The unit 74 is constructed to vary the rate of the pulse train supplied to the servo circuit 75 in accordance with the signal supplied from the longitudinal position signal generator 73. Although any one of many electrical systems may be used including a counter that divides the frequency of the pulse train generated by the rotary encoder 72.

Figure 12:
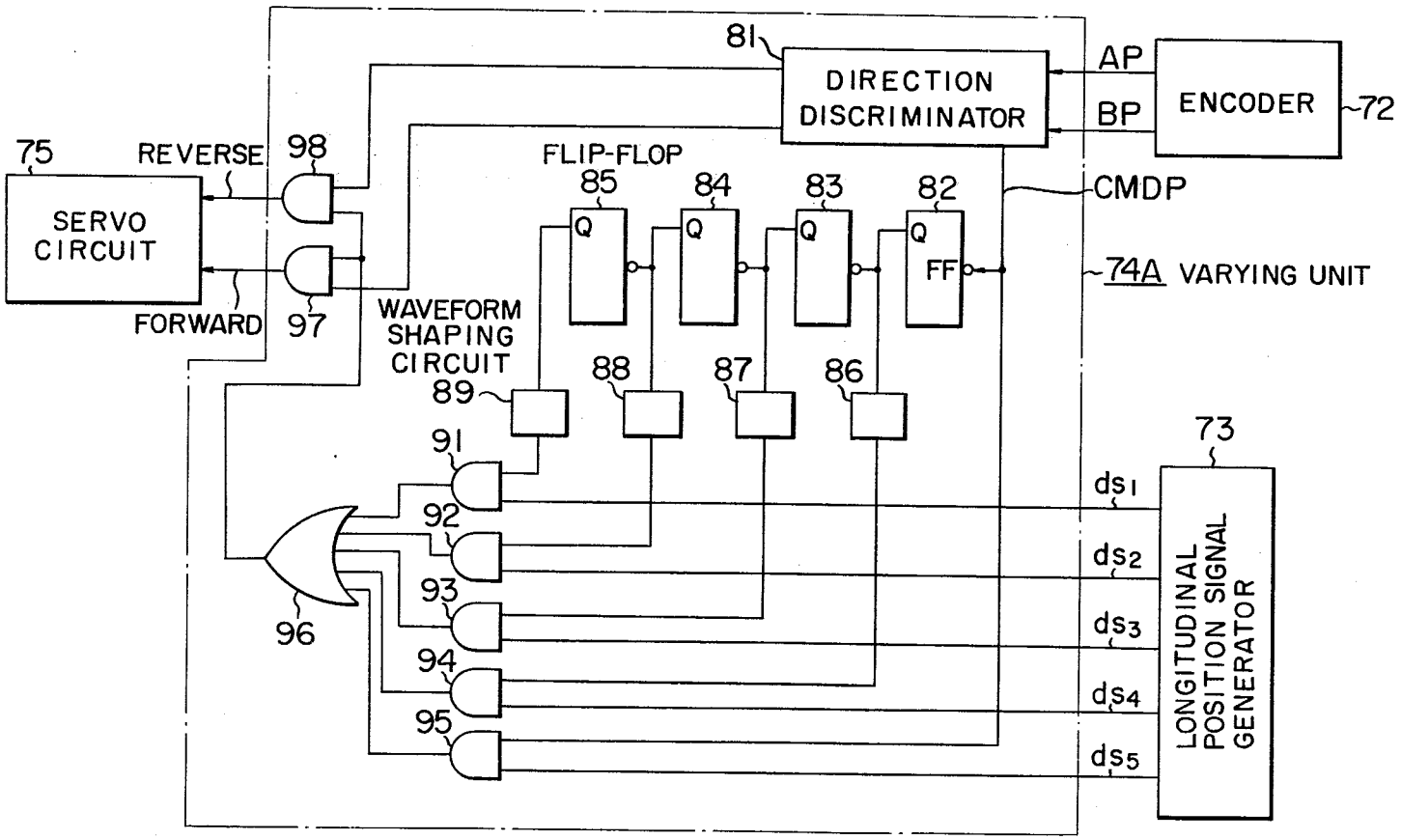
FIG. 12 is a block diagram showing a case wherein the unit 74 shown in FIG. 11 is constituted by a frequency dividing circuit.

FIG. 12 shows one example of such counter. In FIG. 12, the two phase pulse trains AP and BP generated by the encoder 72 are applied to a direction discriminator 81 of the varying unit 74A and the outputs of the direction discriminator 81 are applied to one inputs of AND gate circuits 97 and 98. The discriminator 81 also produces a pulse train CMDP corresponding to a unit movement of the reciprocating carriage and this pulse train is applied to a flip-flop circuit 82 to act as a clock input. To the output of the flip-flop circuit 82 are cascade connected flip-flop circuits 82, 84 and 85 and the pulses appearing at the Q outputs of these flip-flop circuits 82–85 are applied to waveform shaping circuits 86–89 which shape the Q output pulses to have a definite width. The waveform shaping circuits may be formed by monostable multivibrators, for example.

Signals $ds_1$–$ds_4$ generated by the longitudinal position signal generator 73 and corresponding to respective longitudinal positions of the grinding wheel and the outputs of waveform shaping circuits 86–89 are applied to the inputs of AND gate circuits 91–94, respectively, and the outputs of these AND gate circuits are applied to the inputs of an OR gate circuit 96 to apply its output to one inputs of AND gate circuits 97 and 98 together with the outputs of the direction discriminator 81. Consequently, cam 47 is rotated in the forward or reverse direction. In the example shown in FIG. 12, waveform shaping circuits 86 through 89 reduce the frequency of the pulse train CMDP to $\frac{1}{2}$, $\frac{1}{4}$, $\frac{1}{8}$ and 1/16 respectively. Consequently, up to a certain longitudinal position, by an output $ds_5$="1" the AND gate circuit 95 is enabled to longitudinally move the carriage by pulse train CMDP. In order to reduce the frequency of the pulse train CMCP to $\frac{1}{2}$, output $ds_4$ is made to be "1" and the other outputs are made to be "0".

Figure 13:
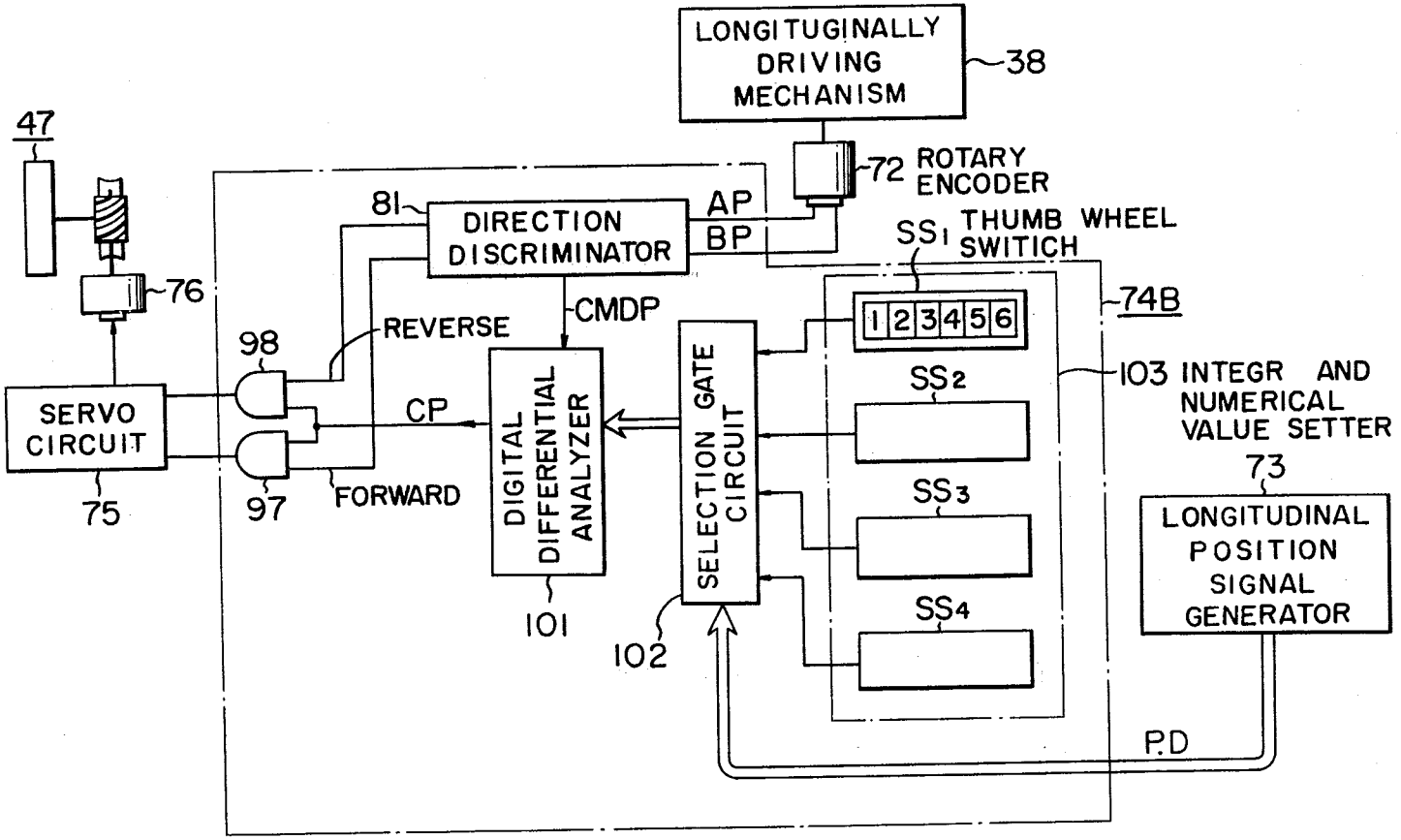
FIG. 13 is a block diagram showing a case wherein the unit 74 shown in FIG. 11 is constituted by a digital differential analyzer and a group of thumb wheel switches.

FIG. 13 shows another example of the unit 74 for varying pulse speed and direction of rotation of the cam shown in FIG. 11. More particularly, the output pulse train CMDP of the direction discriminator 81 is applied to a digital differential analyzer (DDA) 100 to act as an operation instruction pulse. There is provided an integrand numerical value setter 103 including a plurality of thumb wheel switches $SS_1$–$SS_4$ which apply integrands to the digital differential analyzer 101. These switches are selected by the output of the longitudinal position signal generator 73 through a selection gate circuit 102. According to this modification, since it is possible to adjust a carry pulse train CP generated by DDA 101 by varying the numerical value of a certain thumb wheel switch, it is possible to more finely and continuously vary the frequency division ratio of the pulse train CMDP.

Figure 14:
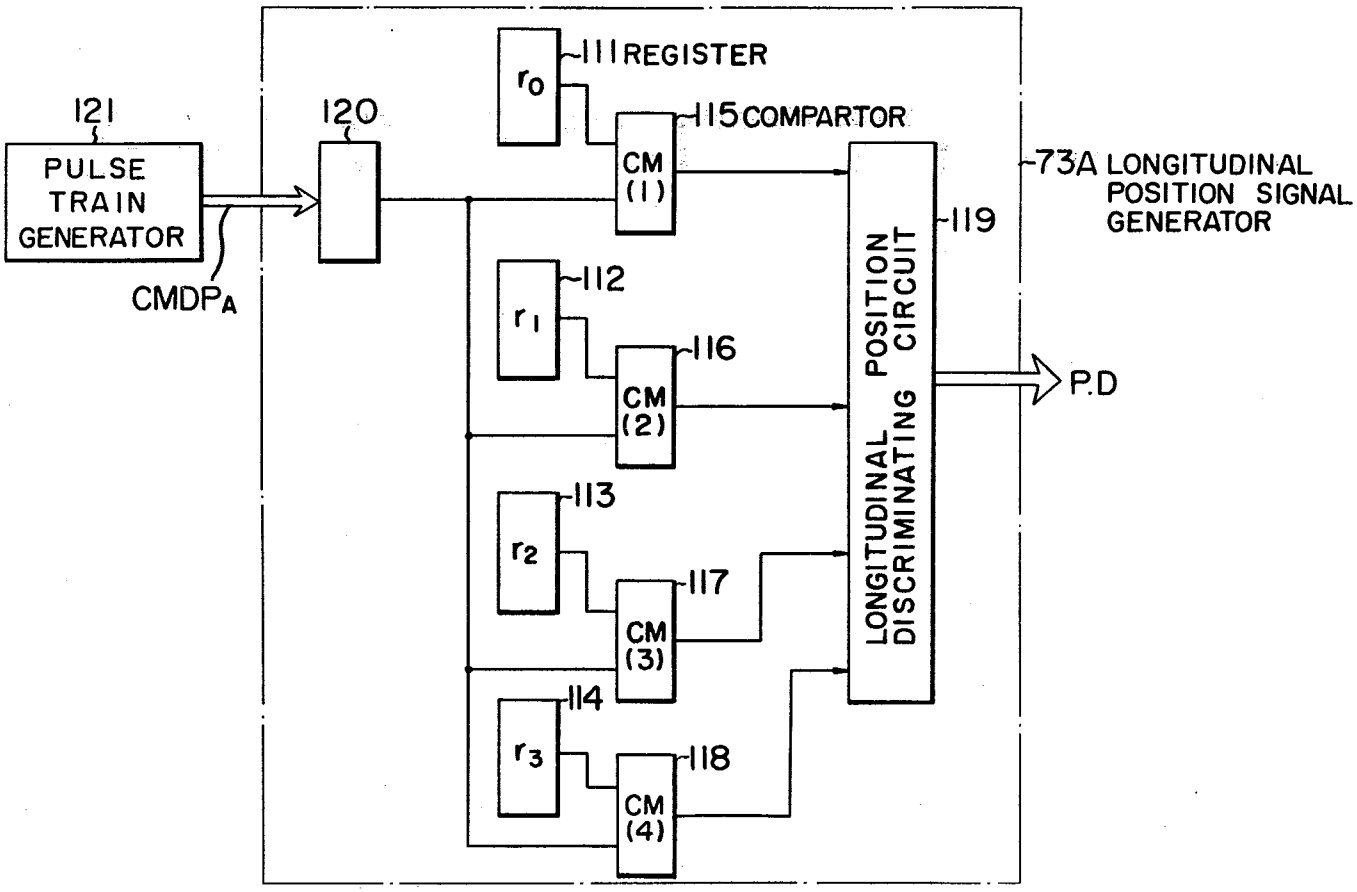
FIG. 14 is a block diagram showing a case wherein the detected signal generator 73 is constituted by registers and a reversible counter.

FIG. 14 is a block diagram showing the connection of an electrical longitudinal position signal generator 73A. The output of the longitudinal position signal generator 73A is applied to unit 74 shown in FIG. 11. The signal generator 73A can be substituted for dogs and limit switches for supplying clutch transfer signals to reduction gear box 41 shown in FIG. 7. Assume now that points $Q_1$, $Q_2$ and $Q_3$ spaced from the center $Q_4$ of the roll R by distances $r_1$, $r_2$ and $r_3$ resepectively are suitably designated. These distances $r_0$ (=0), $r_1$, $r_2$ and $r_3$ corresponding to positions $Q_0$, $Q_1$, $Q_2$ and $Q_3$, (FIG. 18) are respectively set in registers 111–114 shown in FIG. 14.

There are provided comparators 115–118. Each comparator compares the output of one of the registers with the output of a reversible counter 120 which is supplied with the pulse train CMDPA generated by a pulse train generator 121. The reversible counter 120 is set to zero when the grinding wheel is positioned at the starting position, that is at the center $Q_0$ of the roll. Consequently, each time the grinding wheel passes through points $Q_0$, $Q_1$, $Q_2$ and $Q_3$ shown in FIG. 16, respective comparators 115–118 produce coincidence signals. A longitudinal position discriminating circuit 119 discriminates the output signals of comparators 115–118 to produce a detected signal P.D.

Figure 15:
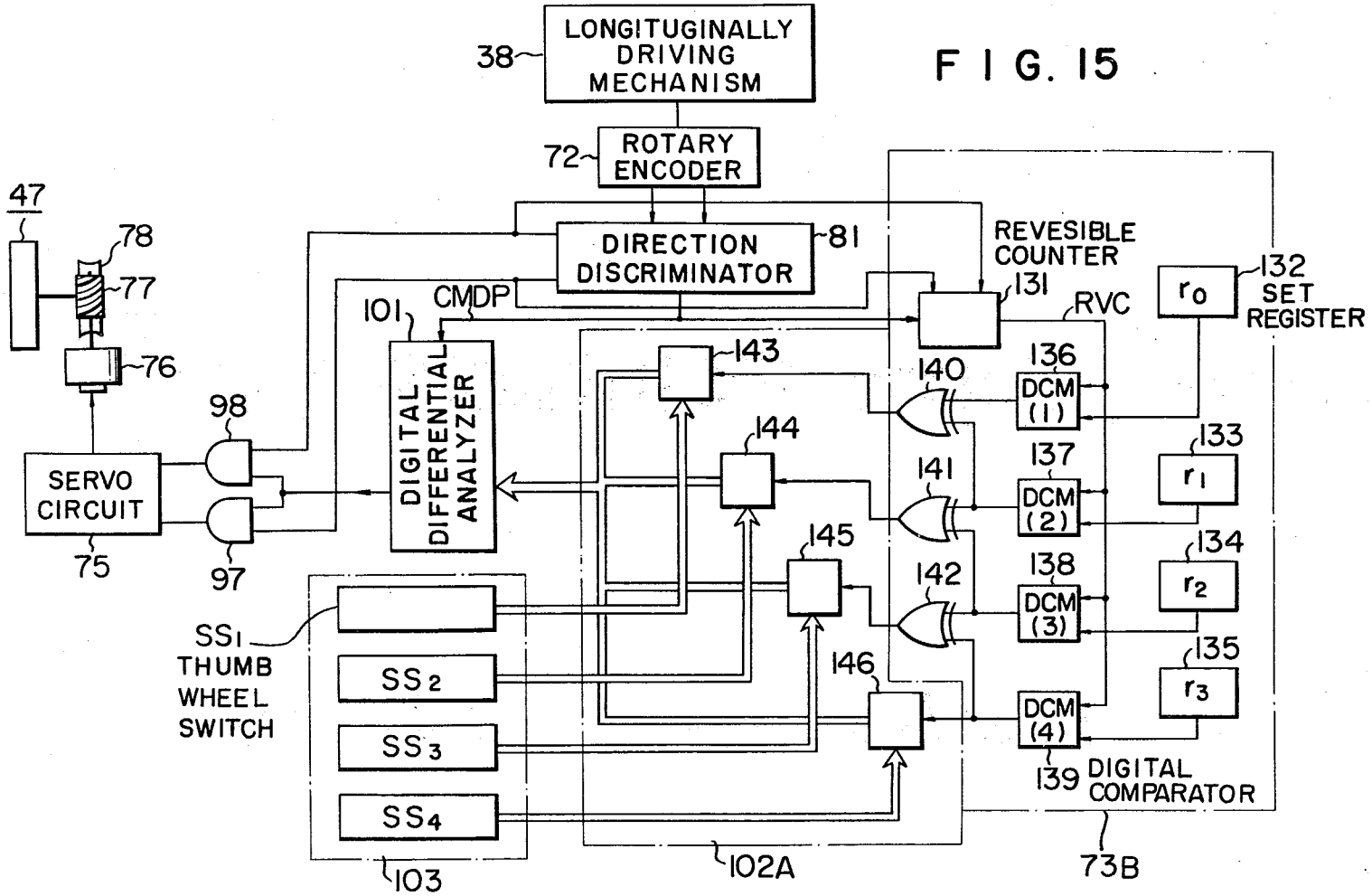
FIG. 15 is a block diagram showing the detail of the selection gate 102 and the detected signal generator 73 shown in FIG. 13.
Figure 16:
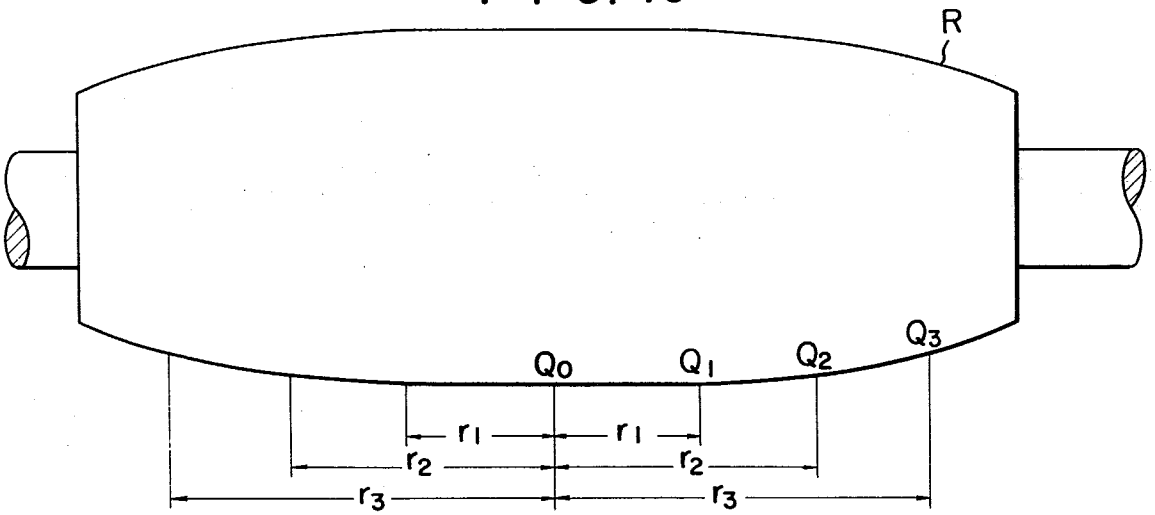
FIG. 16 shows a profile of a cambered roll.

FIG. 15 shows the detail of the selection gate circuit 102 and the longitudinal position signal generator 73 shown in FIG. 14. There are provided set registers 132–135 in which positions $Q_0$–$Q_3$ shown in FIG. 16 are respectively set, and digital comparators 136–139 which judge whether the count RVS of a reversible counter 131 is larger or smaller than the count $R_1$ of register 133, for example. Thus, when $RVC > R_1$ the output DCM (2) of register 137 is zero. In the same manner when $RVC \geqq R_1$, DCM (2)="1". Exclusive OR gate circuits 140–142 have inputs connected to the outputs of digital comparators 136–139 as shown so as to produce outputs "1" when their inputs are "0" and "1" or "1" and "0". Gate circuits 143–146 are provided to apply the numerical values of thumb wheel switches $SS_1$–$SS_4$ to DDA 101. Thus, these gate circuits 143, 144 and 145 apply the numerical data of thumb wheel switches $SS_1$, $SS_2$ and $SS_4$ when the outputs of the exclusive OR gate circuits 140, 141 and 142 are "1", whereas the exclusive OR gate circuit 146 applies the numerical value of the thumb wheel switch $SS_4$ to DDA 101 when DCM (4)="1". Assume now that distances 0, $r_1$, $r_2$ and $r_3$ are set in registers 132–135 respectively. When the grinding wheel is moved between points $Q_0$ and $Q_1$, DCM(1)="1", DCM(2)=DCM(3)=DCM(4)="0" so that only the OR gate circuit 140 is enabled to apply respective bits of the thumb wheel switch $SS_1$ to DDA 101 via gate circuit 143. When the grinding wheel reaches point $Q_1$ DCM(1)=DCm(2)="1"

DCM(3)=DCM(4)="0"

As a consequence, until point $Q_2$ is reached only OR gate circuit 141 is enabled to supply the numerical value of thumb wheel switch $SS_2$ to DDA 101 via gate circuit 144.

When the grinding wheel reaches point $Q_2$

DCM(1)=DCM(2)=DCM(3)="1"

DCM (4)="0"

Thus, until point $Q_3$ is reached only OR gate circuit 142 is enabled to apply the numerical value of thumb wheel switch $SS_3$ to DDA 101 via gate circuit 145. While the grinding wheel is moving between point $Q_3$ and the righthand end of the roller R DCM(1)=DCM(2)=DCM(3)=DCM(4)="1" thus disenabling OR gate circuits 140, 141 and 142. Accordingly, the numerical value of the thumb wheel switch is applied directly to DDA101 through gate circuit 146 when DCM(4)="1". In the same manner, when the grinding wheel is moved from the righthand end to the lefthand end of the roll, gate circuits 146–143 are enabled sequentially. In the lefthand half of the roll, the numerical values of thumb wheel switches $SS_1$–$SS_4$ are sequentially applied to DDA 101 in the same manner.

Figure 17:
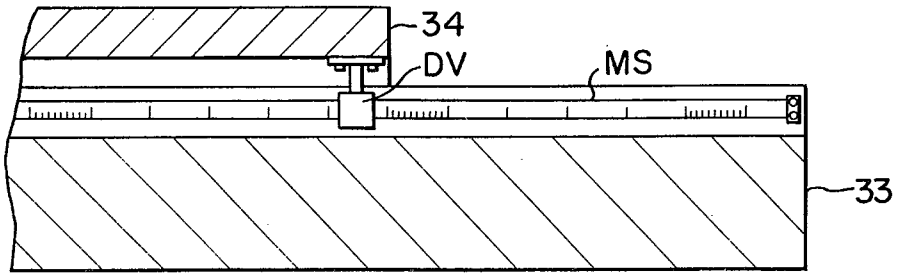
FIG. 17 is a sectional view taken along a line XVII—XVII shown in FIG. 5.

FIG. 17 is an enlarged sectional view taken along line XVII–XVII shown in FIG. 5 showing a linear movement detector which generates a pulse train corresponding to the amount of longitudinal movement of the grinding wheel. As shown, a magnetic scale MS is bonded to the upper side wall of the rear bed 33, and a detector DV opposing the magnetic scale MS is mounted at one end of the reciprocating carriage 34 for generating a sine wave or a pulse each time the carriage 34 moves over a unit distance.

The pulse generated by the detector DV is processed in the same manner as the pulse generated by the rotary encoders shown in FIGS. 11, 12, 13 and 15.

The invention has the following advantages.

(1) According to this invention, since means to detect the positions during the longitudinal movment of the grinding wheel is provided to vary the speed of the cam by the detected signal, it is possible to form cambering curves of any desired profile.

(2) Since means is provided for varying the detecting positions in the longitudinal direction so as to vary the speed of the cambering cam it is possible to variously vary the cambering curve.

(3) Since the longitudinal positions at which the speed of the cambering cam is varied are set by such electrical means as registers it is easy to vary the set values, that is the longitudinal positions.

(4) Since the cambering cam is driven by a servomotor or a pulse motor it is not necessary to transmit the rotation of the longitudinally driving mechanism to the cam through mechanical means thereby simplifying the construction.

(5) Since a linearly moving position detector or a rotary encoder is used it is possible to produce pulse trains which are synchronous with the longitudinal movement.

(6) As the pulse train is applied to a digital differential analyzer as an operation instruction signal, and as the integrand to the digital differential analyzer is produced by a plurality of such means in which numerical values can be readily set as thumb wheel switches which are selectable at various longitudinal positions it is possible to form many types of cambering curves with a single cam.

(7) In one embodiment, since dogs and limit switches are used as the means for generating the position signals, where the number of the cam speed changing points is only several such position signal generating means can be prepared at a low cost.

(8) Furthermore as the cam is driven by the longitudinal feed mechanism through a variable ratio gear box, where it is necessary to vary the speed of the cam in only several steps, the invention can be carried out at a relatively low cost since it is sufficient to add a relatively simple variable ratio gear train.

Since the cambering curve is generally symmetrical with reference to the longitudinal center in the foregoing embodiments position detectors have been shown only for the righthand half. However it should be understood that the invention is also applicable to asymmetrical cambering curves.

We claim:

1. In a cambering device of a roll grinding lathe of the type comprising means for driving a grinding wheel in the longitudinal direction of said roll, a cambering cam for swinging said grinding wheel toward and away from the center of said roll and means for rotating said cam in accordance with a position of said grinding wheel in the longitudinal direction thereby forming a cambered profile on the surface of said roll, the improvement which comprises means to detect a predetermined position along the longitudinal axis of said roll to which said grinding wheel has been moved during longitudinal movement, and means responsive to the output of said position detecting means for varying the rotational speed of said cam.

2. The cambering device according to claim 1 wherein said last mentioned means comprises a variable ratio gear train interposed between said means for driving the grinding wheel in the longitudinal direction and said cam rotating means, and means responsive to the output of said position detecting means for changing the gear ratio of said variable ratio gear train.

3. The cambering device according to claim 1 wherein said position detecting means comprises dogs and limit switches which are adjustable in the longitudinal direction of said roll.

4. The cambering device according to claim 1 wherein said position detecting means comprises at least one numerical value set means, a pulse generator which produces a pulse as said grinding wheel is moved in the longitudinal direction of said roll, means for counting the number of said pulses, and a comparator which produces a signal when the count of said counting means coincides with a numerical value set in said numerical value set means.

5. In a cambering device of a roll grinding lathe of the type comprising means for driving a grinding wheel in the longitudinal direction of said roll, a cambering cam for swinging said grinding wheel toward and away from the center of said roll, the improvement which comprises means to detect a predetermined position along the longitudinal axis of said roll to which said grinding wheel has been moved during oongitudinal movement, means responsive to the output of said position detecting means for varying the rotational speed of said cam, and means for rotating said cam in accordance with a position of said grinding wheel in the longitudinal direction, said cam rotating means including a linear position detector which detects the position of said grinding wheel in the longitudinal direction of the roll for producing an output signal, a driving motor for rotating said cam, and means for controlling the speed and direction of rotation of said driving motor in accordance with the outputs of said linear position detector and of said position determining means.

6. In a cambering device of a roll grinding lathe of the type comprising means for driving a grinding wheel in the longitudinal direction of said roll, a cambering cam for swinging said grinding wheel toward and away from the center of said roll, the improvement which comprises means to detect a predetermined position along the longitudinal axis of said roll to which said grinding wheel has been moved during longitudinal movement, means responsive to the output of said position detecting means for varying the rotational speed of said cam and means for rotating said cam in accordance with a position of said grinding wheel in the longitudinal direction, said cam rotating means including a rotary encoder which is driven by said means for driving the grinding wheel in the longitudinal direction of said roll, a driving motor for rotating said cam, and means for controlling the speed and direction of rotation of said driving motor in accordance with the outputs of said rotary encoder and of said position detecting means.

* * * * *